US011397036B2

(12) United States Patent
Xue et al.

(10) Patent No.: US 11,397,036 B2
(45) Date of Patent: Jul. 26, 2022

(54) ICE MAKER AND REFRIGERATOR

(71) Applicant: QINGDAO HAIER CO., LTD., Qingdao (CN)

(72) Inventors: Jianjun Xue, Qingdao (CN); Qihai Du, Qingdao (CN); Yanqing Zhang, Qingdao (CN); Xiaobing Zhu, Qingdao (CN)

(73) Assignee: QINGDAO HAIER CO., LTD., Qingdao (CN)

( * ) Notice: Subject to any disclaimer, the term of this patent is extended or adjusted under 35 U.S.C. 154(b) by 44 days.

(21) Appl. No.: 16/980,831

(22) PCT Filed: Dec. 26, 2018

(86) PCT No.: PCT/CN2018/123734
§ 371 (c)(1),
(2) Date: Sep. 14, 2020

(87) PCT Pub. No.: WO2019/205690
PCT Pub. Date: Oct. 31, 2019

(65) Prior Publication Data

US 2021/0364211 A1 Nov. 25, 2021

(30) Foreign Application Priority Data

Apr. 25, 2018 (CN) ..... 201810380405.0

(51) Int. Cl.
*F25C 1/04* (2018.01)
*F25C 1/243* (2018.01)
*F25C 5/06* (2006.01)

(52) U.S. Cl.
CPC ..... *F25C 1/04* (2013.01); *F25C 1/243* (2013.01); *F25C 5/06* (2013.01); *F25C 2400/10* (2013.01)

(58) Field of Classification Search
CPC .... F25C 1/04; F25C 1/243; F25C 5/06; F25C 2400/10; F25C 1/246; F25C 2400/08;
(Continued)

(56) References Cited

U.S. PATENT DOCUMENTS 6,438,988 B1 * 8/2002 Paskey ..... F25C 1/00 62/353
2007/0227176 A1 * 10/2007 Anell et al. ..... F25C 1/22 62/340
2017/0336124 A1 * 11/2017 Visin et al. ..... F25C 5/06

FOREIGN PATENT DOCUMENTS

CN 1598451 A 3/2005
CN 1705853 A 12/2005
(Continued)

*Primary Examiner* — Elizabeth J Martin
*Assistant Examiner* — Dario Antonio Deleon
(74) *Attorney, Agent, or Firm* — Cheng-Ju Chiang

(57) ABSTRACT

An ice maker and a refrigerator are provided The ice maker has an ice making tray having a plurality of ice making spaces, a motor assembly for driving the ice making tray, and a bracket, the motor assembly is connected to the bracket, and the ice making tray has one end rotationally supported at the bracket; the ice maker further has a fan mounted at the bracket, the bracket has a top plate located at an upper portion of an opening of the ice making space and a side plate located at one side of the top plate, one end of the ice making tray is supported at the side plate, a supporting plate extends from a side edge of the side plate relative to the ice making tray, and the fan is connected to the supporting plate and has an air guide direction towards the ice making tray.

10 Claims, 4 Drawing Sheets

(58) Field of Classification Search
CPC .. F25C 5/20; F25C 2700/06; F25C 2305/022; F25C 2305/0221; F25D 2317/061; F25D 23/12
See application file for complete search history.

(56) References Cited

FOREIGN PATENT DOCUMENTS

| | | | |
|---|---|---|---|
| CN | 201045550 | Y | 4/2008 |
| CN | 202393118 | U | 8/2012 |
| CN | 103363753 | A | 10/2013 |
| CN | 107763914 | A | 3/2018 |
| CN | 107940846 | A | 4/2018 |
| CN | 108895740 | A | 11/2018 |
| JP | 2017-161086 | A | 9/2017 |
| KR | 10-2004-0034271 | A | 4/2004 |
| WO | 2016/037909 | A1 | 3/2016 |

* cited by examiner

ICE MAKER AND REFRIGERATOR

The present application is a 35 U.S.C. § 371 National Phase conversion of International (PCT) Patent Application No. PCT/CN2018/123734, filed on Dec. 26, 2018, which claims priority to Chinese Patent Application No. 201810380405.0, filed on Apr. 25, 2018 and titled "Ice maker and refrigerator", which is incorporated herein by reference in its entirety. The PCT International Patent Application was filed and published in Chinese.

TECHNICAL FIELD

The present invention relates to the field of household appliances, and in particular, to an ice maker and a refrigerator.

BACKGROUND

Usually, an ice maker provided in a refrigerator makes ice with cold energy of the refrigerator. Generally, the ice maker is supplied with air by a dedicated ice-making air duct, not only causing a complicated structure, but also usually making the ice maker share an air supply fan with a freezing compartment; when a freezing process is stopped, the cold energy of the ice maker is required to be obtained by means of heat conduction. When the refrigerator is not provided with the dedicated ice-making air duct for air supply, the cold energy of the ice maker is obtained by way of heat conduction, and a heat exchange is relatively slow, resulting in a low ice making rate.

SUMMARY

An object of the present invention is to provide an ice maker and a refrigerator achieving a high ice making efficiency.

In order to achieve one of the above-mentioned objects, one embodiment of the present invention provides an ice maker, comprising an ice making tray having a plurality of ice making spaces, a motor assembly for driving the ice making tray, and a bracket, wherein the ice making space has an opening, the motor assembly is connected to the bracket, and the ice making tray has one end rotationally supported at the bracket and the other end connected with and driven to rotate by the motor assembly; the ice maker further comprising a fan mounted at the bracket, the bracket comprises a top plate located at an upper portion of the opening and a side plate located at one side of the top plate, one end of the ice making tray is supported at the side plate, a supporting plate extends from a side edge of the side plate relative to the ice making tray, and the fan is connected to the supporting plate and has an air guide direction towards the ice making tray.

As a further improvement of an embodiment of the present invention, the fan is configured as a blowing fan, provided adjacent to an air port of a refrigerator, so as to blow cold air to the ice making tray.

As a further improvement of an embodiment of the present invention, the fan is configured as a sucking fan, provided adjacent to the air port of the refrigerator, so as to suck the cold air into the ice making tray.

As a further improvement of an embodiment of the present invention, an inclined angle less than or equal to 75 degrees is formed between an extension direction of the supporting plate and a direction from one end to the other end of the ice making tray.

As a further improvement of an embodiment of the present invention, further comprising a control board electrically connected with the motor and the fan, for controlling operations thereof.

As a further improvement of an embodiment of the present invention, an opening is provided at a joint between the side plate and the supporting plate, and an electric wire of the fan passes through the opening.

As a further improvement of an embodiment of the present invention, a rotary center line of the fan is located between an upper surface and a lower surface of the ice making tray.

As a further improvement of an embodiment of the present invention, the supporting plate is provided with a fan hole, a plurality of screw holes are provided around the fan hole uniformly, and the fan is connected to the screw holes by screws, so as to be fixed to a side of the supporting plate towards the ice making tray.

As a further improvement of an embodiment of the present invention, a fixed block is provided at a middle portion of the ice making tray and fixedly clamped to a bottom of the ice making space, an ice twisting rod has one end movably inserted into the fixed block circumferentially and the other end abutted against the motor assembly, extends from the middle portion of the ice making tray to a position of the ice making tray connected with the motor assembly, and is then bent by 90 degrees to extend towards one side of the ice making tray, and the ice making tray is rotated in a first direction to abut against the ice twisting rod to be deformed for releasing ice, and in a second direction opposite to the first direction to be separated from a part of the ice twisting rod.

In order to achieve one of the above-mentioned object, an embodiment of the present invention provides a refrigerator, comprising a cabinet, a door for opening or closing the cabinet, and the ice maker according to any one of the embodiments as described above, wherein the ice maker is provided at the cabinet or the door.

Compared with a prior art, the present invention has the following beneficial effects. In the technical solution of the present invention, a fan is connected to a bracket of the ice maker and enables cold air to enter an ice making tray directly, such that cold energy of the ice maker comes from forced-convection cold air, with a high forced convection efficiency, simple structure, and high ice making efficiency.

DETAILED DESCRIPTION

Figure 1:
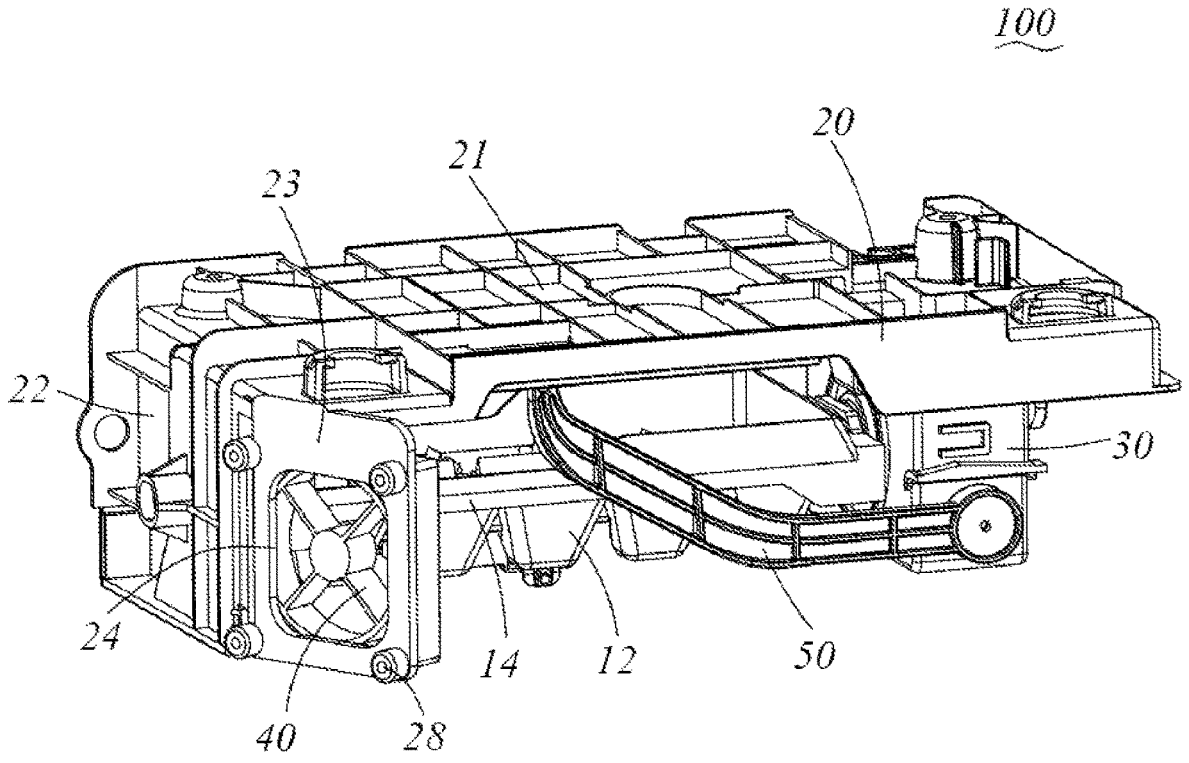
FIG. 1 is a schematic perspective diagram of an ice maker according to an embodiment of the present invention.

The present invention will be described in detail below with reference to the specific embodiments shown in the accompanying drawings. However, these embodiments are not intended to limit the present invention, and modifications in structures, methods, or functions made by those common skilled in the art according to these embodiments are all included in the protection scope of the present invention.

In the description about the embodiments of the present invention, the orientation or positional relation indicated by terms such as "upper," "lower," "front," "rear," "left," "right," "vertical," "horizontal," "bottom," "inner," and "outer" should be construed to refer to the orientation or positional relation as shown in the drawings. Usually, these terms are used by taking the ice maker in a normal state as a reference, and are not intended to indicate that the position or element in question must have a specific orientation.

Also, it should be understood that although the terms of first, second, etc. may be used herein to describe various elements or structures, the above-mentioned objects should not be limited by them. The above-mentioned terms are merely used to distinguish these described objects. For example, a first side portion may be referred to as a second side portion, and similarly, the second side portion may also be referred to as the first side portion, without departing from the protection scope of the application.

A first preferred embodiment of the present invention discloses a refrigerator, comprising a cabinet (not shown) defining a storage chamber and a door (not shown) for opening or closing the cabinet, wherein a number and a structural form of the storage chamber may be configured according to different needs. Usually, the storage chamber comprises a refrigerating compartment and a freezing compartment.

Figure 2:
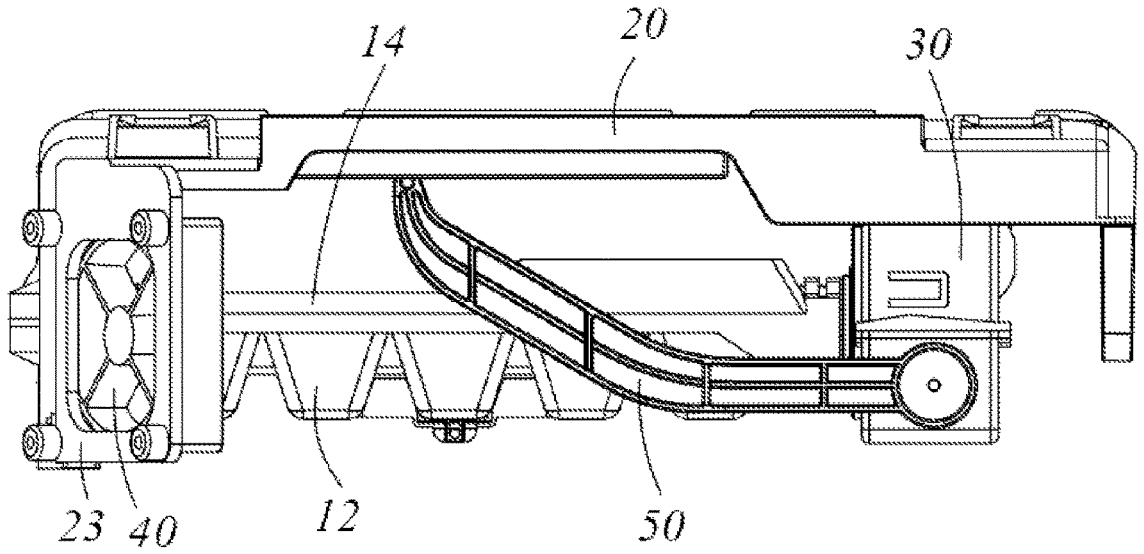
FIG. 2 is a front view of the ice maker in FIG. 1.
Figure 3:
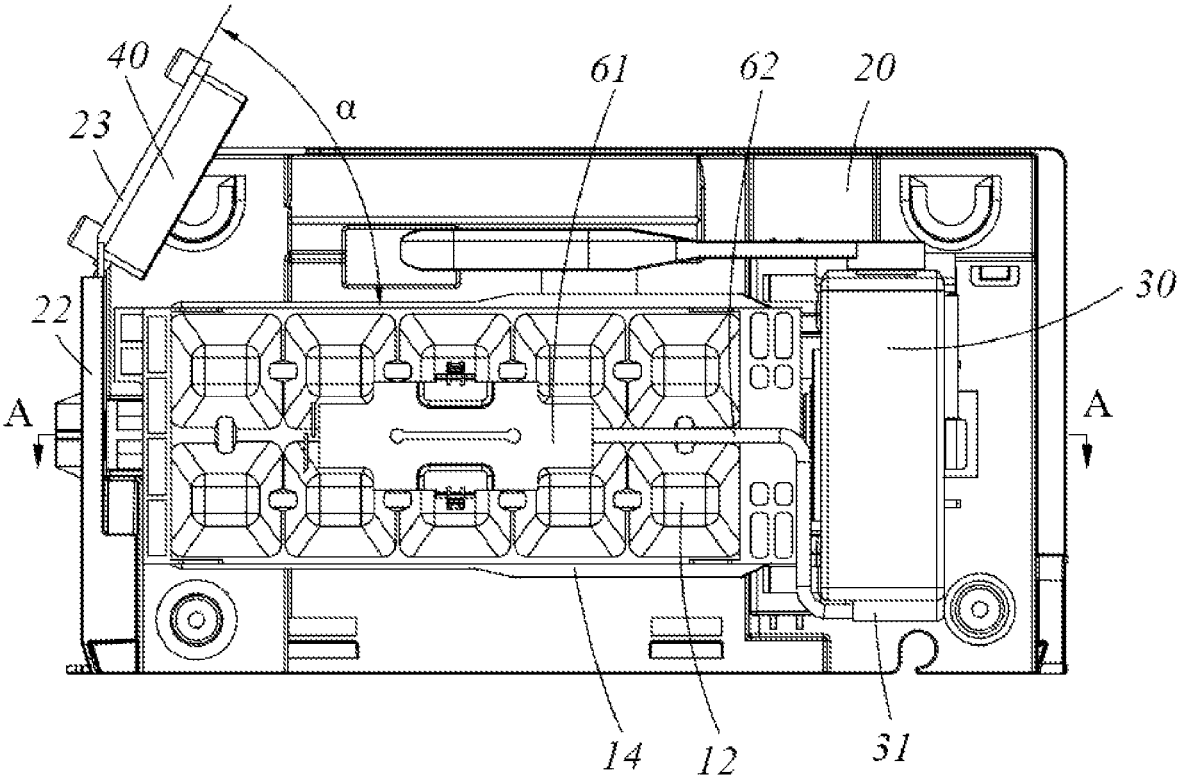
FIG. 3 is a bottom view of the ice maker in FIG. 1.
Figure 4:
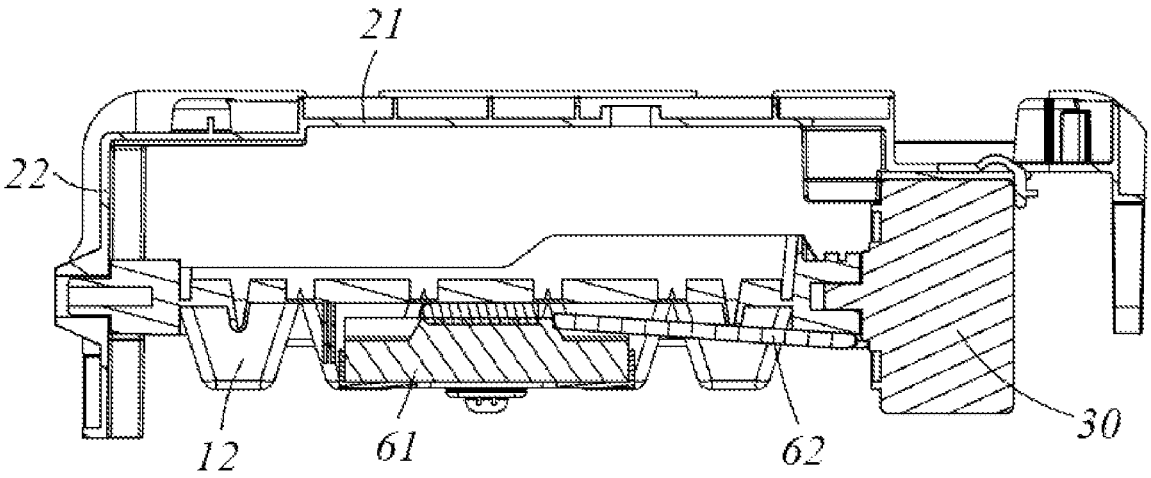
FIG. 4 is a schematic sectional diagram along line A-A in FIG. 3.
Figure 5:
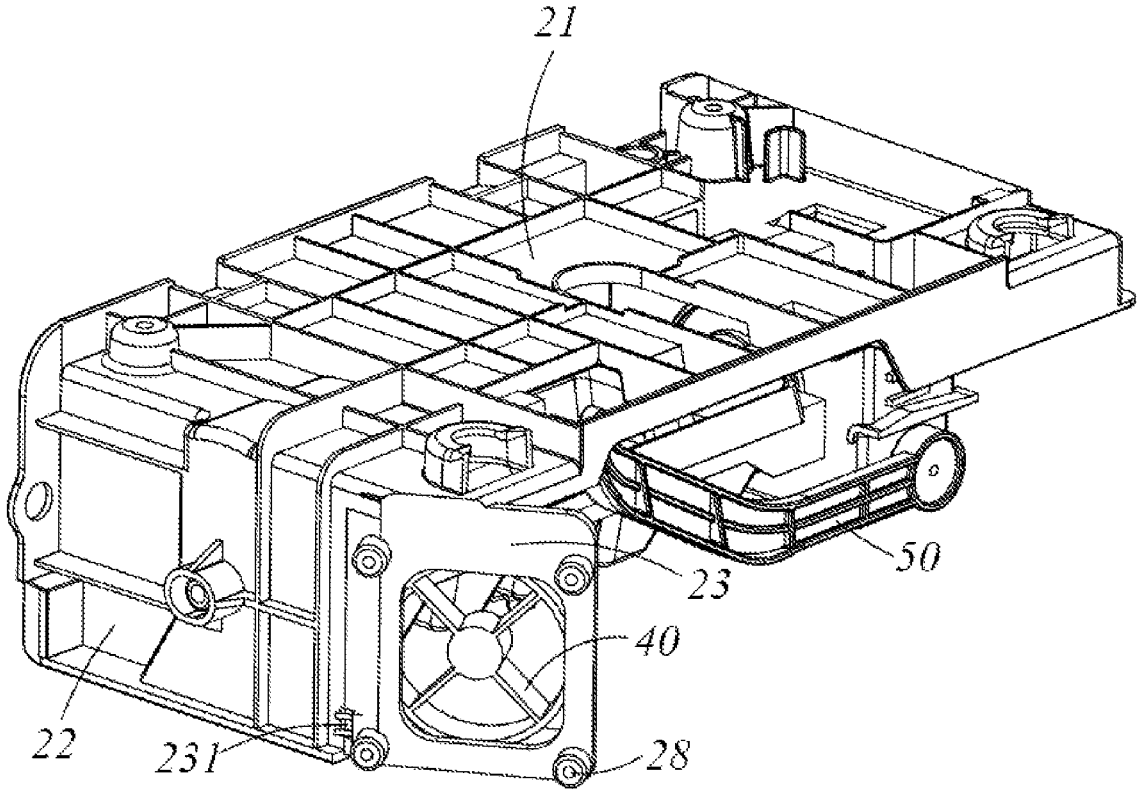
FIG. 5 is a schematic perspective diagram of the ice maker in FIG. 1 from another perspective.
Figure 6:
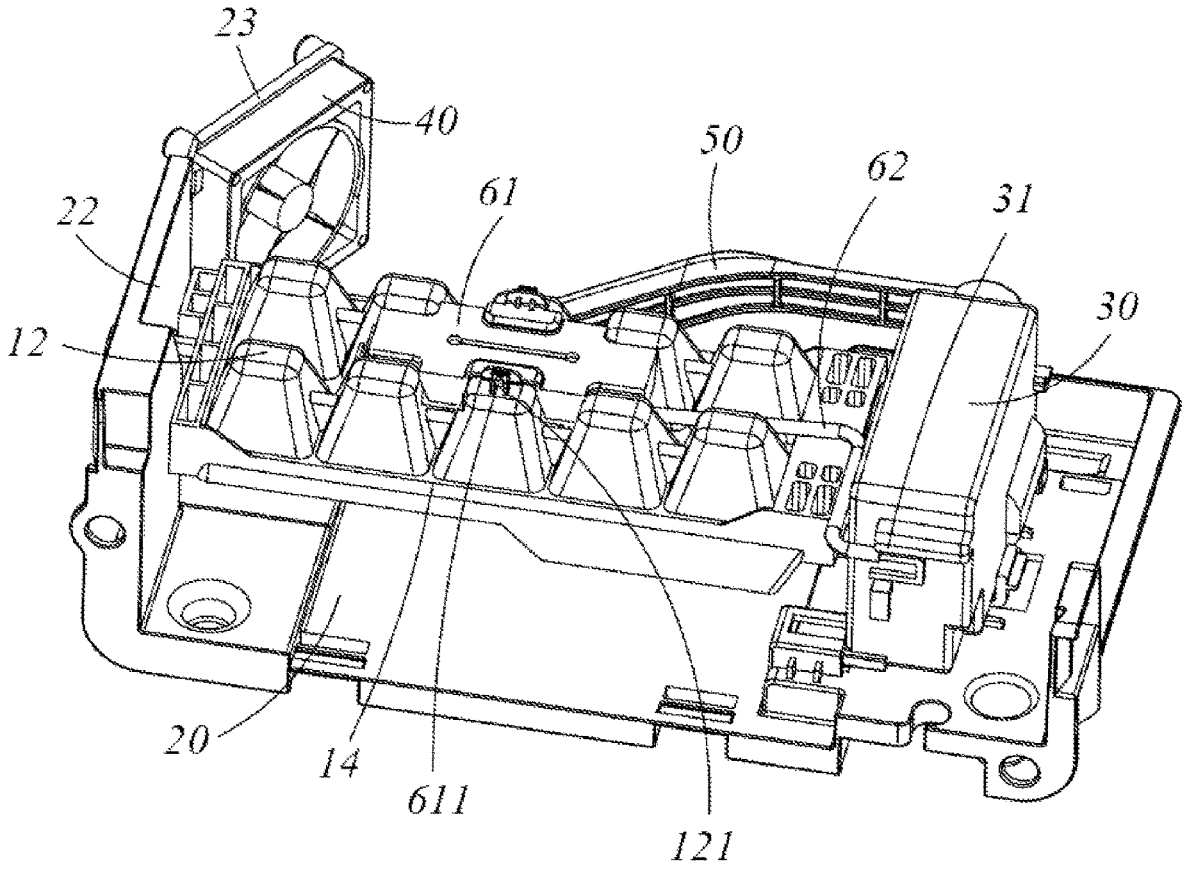
FIG. 6 is a schematic perspective diagram of the ice maker in FIG. 1 from still another perspective.

As shown in FIGS. 1 to 6, the refrigerator further comprises an ice maker 100 provided at the cabinet or the door. The ice maker 100 comprises an ice making tray 14 having a plurality of ice making spaces 12 with openings, and further comprises a bracket 20 and a motor assembly 30 for driving the ice making tray 14 to rotate, wherein the motor assembly 30 is connected to the bracket 20, and the ice making tray 14 has one end rotationally supported on the bracket 20 and the other end connected with and driven to rotate by the motor assembly 30, such that the ice making tray 14 may be twisted to release ice after the ice is made.

In the preferred embodiment, the ice maker 100 further comprises a fan 40 mounted on the bracket 20, the bracket 20 comprises a top plate 21 located at an upper portion of the opening and a side plate 22 located at one side of the top plate 21, one end of the ice making tray 14 is supported at the side plate 22, a supporting plate 23 extends from a side edge of the side plate 22 relative to the ice making tray, and the fan 40 is connected to the supporting plate 23 and has an air guide direction towards the ice making tray 14. Cold air is blown to the ice making space 12 directly by the fan 40, such that cold energy of the ice maker 100 comes from the forced-convection cold air; furthermore, the fan 40 is close to the ice maker 100, and a forced convection efficiency is high, such that a structure is simple, and an ice making efficiency is high.

In detail, the fan 40, configured as a blowing fan 40, is provided adjacent to an air port of the refrigerator, so as to blow the cold air to the ice making tray. Certainly, the fan 40 may also be configured as a sucking fan 40, provided opposite to the air port of the refrigerator, so as to suck the cold air into the ice making tray.

In the preferred embodiment, the supporting plate 23 and the bracket 20 may be arranged detachably. Certainly, the supporting plate 23 and the bracket 20 may also be integrally formed. Specifically, the supporting plate 23 is provided with a fan hole 24 configured as a square hole, four screw holes 28 are provided around the fan hole 24 uniformly, and the fan 40 is connected to the screw holes 28 by four screws, so as to be fixed to a side of the supporting plate 23 towards the ice making tray 14. Certainly, the fan may also be connected to the supporting plate in other ways, such as riveted connection, clamped connection, or the like. An inclined angle $\alpha$ less than or equal to 75 degrees is formed between an extension direction of the supporting plate 23 and a direction from one end to the other end of the ice making tray 14, and is preferably 60 degrees in the present embodiment, such that the furthest ice making space may be blown. An opening 231 is provided at a joint between the side plate 22 and the supporting plate 23, and an electric wire of the fan 40 passes through the opening 231. In addition, a rotary center line of the fan 40 is located between an upper surface and a lower surface of the ice making tray 14, such that the cold air may be blown to not only an upper water surface of the ice making space, but also a bottom surface of the ice making space, thereby speeding up an ice making process.

The ice maker 100 further comprises an ice twisting rod 62 and a fixed block 61 connected with the ice twisting rod 62, the ice making tray 14 has a bottom opposite to the opening, and the fixed block 61 is fixedly clamped to a bottom of the ice making space 12. Specifically, a gap at a middle part of the bottom of the ice making space 12 is filled with the fixed block 61, the ice twisting rod 62 has one end movably inserted into the fixed block 61 circumferentially and the other end abutted against the motor assembly 30, extends from a middle portion of the ice making tray 14 to a position of the ice making tray 14 connected with the motor assembly 30, and is then bent by 90 degrees to extend towards one side of the ice making tray 14, and the ice making tray 14 is rotated in a first direction to abut against the ice twisting rod 62 to be deformed for releasing the ice, and in a second direction opposite to the first direction to be separated from a part of the ice twisting rod 62. When the ice making tray 14 is rotated until the ice making space 12 has the downward opening, an ice cube is separated from the ice making space 12 to fall into an ice bin (not shown) below the ice maker 100. Specifically, protruding columns 611 extend from two sides of the fixed block 61, slots 121 are provided at the bottoms of the corresponding ice making spaces 12, and the protruding column 611 is clamped in the slot 121 to fix the fixed block 61 relative to the ice making tray 14. The ice twisting rod 62 has the end inserted into the fixed block 61 as a first end and the end abutted against the motor assembly 30 as a second end. Preferably, in the present embodiment, two 90-degree bends are formed from the first end to the second end, such that the second end is abutted against a protrusion 31 at a side portion of the motor assembly 30. When the motor assembly 30 drives the ice making tray 14 to rotate in the first direction, one side of the ice making tray 14 is pressed against the ice twisting rod 62 to be deformed, such that the ice cube is separated from the ice making space 12. Thus, when the motor assembly 30 drives the ice making tray 14 to rotate in the second direction until the ice making space 12 has the downward opening, the ice cube falls automatically under gravity. The ice maker 100 further comprises the ice bin (not shown) provided below the ice making tray 14, for receiving the ice cube made by the ice making tray 14. When the ice making tray 14 is driven to rotate in the second direction by the motor assembly 30, the ice cube in the ice making space 12 falls into the ice bin.

The ice maker 100 further comprises a control board (not shown) electrically connected with the motor assembly 30 and the fan 40, for controlling operations of the motor assembly 30 and the fan 40. In addition, the motor assembly 30 is further connected with an ice detection rod 50 which may be rotated by a certain angle. When the ice bin is full of ice, the ice cube at a top layer will limit rotation of the ice detection rod 50, a full ice signal is transferred to the control board to stop the fan 40, and the cold air is stopped from being delivered to the ice making tray 14, thereby stopping making ice.

In order to make ice release of the ice making tray 14 easier and further improve the ice making efficiency, the ice making tray 14 is made of an elastic plastic material, and in particular, rubber, silica gel, or the like. Certainly, the ice making tray 14 may also be made of other plastic materials.

It should be understood that although the description is described according to the above embodiments, each embodiment may not only comprise one independent technical solution. The presentation manner of the description is only for the sake of clarity. Those skilled in the art should take the description as an integral part. The technical solutions of the respective embodiments may be combined properly to form other embodiments understandable by those skilled in the art.

The above detailed description only illustrates the feasible embodiments of the present invention, and is not intended to limit the protection scope of the present invention. Equivalent embodiments or modifications within the scope and spirit of the present invention shall be embraced by the protection scope of the present invention.

What is claimed is:

1. An ice maker, comprising an ice making tray having a plurality of ice making spaces, a motor assembly for driving the ice making tray, and a bracket, wherein each ice making space of the plurality of ice making spaces has an opening, the motor assembly is connected to the bracket, and the ice making tray has one end rotationally supported at the bracket and another end connected with and driven to rotate by the motor assembly; the ice maker further comprises a fan mounted at the bracket, the bracket comprises a top plate located at an upper portion of the opening and a side plate located at one side of the top plate, the one end of the ice making tray is supported at the side plate, a supporting plate extends from a side edge of the side plate relative to the ice making tray, and the fan is connected to the supporting plate and has an air guide direction towards the ice making tray, wherein a fixed block is separately provided at a middle portion of a bottom of the ice making tray where the opening of the each ice making space is located and fixedly clamped thereto, a gap at the middle portion of the bottom of the ice making tray is filled with the fixed block, an ice twisting rod has one end thereof movably inserted into the fixed block and the other end thereof abutted against the motor assembly, the ice twisting rod extends from the middle portion of the ice making tray to a position of the ice making tray connected with the motor assembly, and is then bent by 90 degrees to extend towards one side of the ice making tray, and the ice making tray is rotated in a first direction to abut against the ice twisting rod to be deformed for releasing ice, and in a second direction opposite to the first direction to be separated from a part of the ice twisting rod, protruding columns extend from two sides of the fixed block, slots are provided at the bottom of the ice making tray, and each of the protruding columns is correspondingly clamped in each of the slots to fix the fixed block relative to the ice making tray.

2. The ice maker according to claim 1, wherein the fan is configured as a blowing fan, provided adjacent to an air port of a refrigerator, so as to blow cold air to the ice making tray.

3. The ice maker according to claim 1, wherein the fan is configured as a sucking fan, provided adjacent to the air port of the refrigerator, so as to suck the cold air into the ice making tray.

4. The ice maker according to claim 1, wherein an inclined angle less than or equal to 75 degrees is formed between an extension direction of the supporting plate and a direction from one end to the other end of the ice making tray.

5. The ice maker according to claim 1, further comprising a control board electrically connected with the motor assembly and the fan, for controlling operations of the motor assembly and the fan.

6. The ice maker according to claim 1, wherein an opening is provided at a joint between the side plate and the supporting plate, and an electric wire of the fan passes through the opening.

7. The ice maker according to claim 1, wherein a rotary center line of the fan is located between an upper surface and a lower surface of the ice making tray.

8. The ice maker according to claim 7, wherein the supporting plate is provided with a fan hole, a plurality of screw holes are provided around the fan hole uniformly, and the fan is connected to the screw holes by screws, so as to be fixed to a side of the supporting plate towards the ice making tray.

9. A refrigerator, comprising a cabinet, a door for opening or closing the cabinet, and the ice maker according to claim 1, wherein the ice maker is provided at the cabinet or the door.

10. The ice maker according to claim 1, wherein the ice twisting rod has the one end inserted into the fixed block as a first end and the other end abutted against the motor assembly as a second end, two 90-degree bends are formed from the first end to the second end, the second end is abutted against a protrusion at a side portion of the motor assembly.

* * * * *